US007556109B2

(12) United States Patent
Chen et al.

(10) Patent No.: US 7,556,109 B2
(45) Date of Patent: Jul. 7, 2009

(54) ELECTRIC WHEELCHAIR SUSPENSION

(75) Inventors: Yung-Hsin Chen, Fengshan (TW); Yung-Yuan Liao, Kaohsiung (TW)

(73) Assignee: Kwang Yang Motor Co., Ltd., Kaohsiung (TW)

( * ) Notice: Subject to any disclaimer, the term of this patent is extended or adjusted under 35 U.S.C. 154(b) by 455 days.

(21) Appl. No.: 11/602,820

(22) Filed: Nov. 21, 2006

(65) Prior Publication Data

US 2008/0053720 A1 Mar. 6, 2008

(30) Foreign Application Priority Data

Aug. 31, 2006 (TW) ..... 95132184 A

(51) Int. Cl.
*A61G 5/06* (2006.01)

(52) U.S. Cl. ..... 180/65.1; 180/907; 180/908

(58) Field of Classification Search ..... 180/65.1, 180/22, 24.07, 907, 908; 280/755, 124.1
See application file for complete search history.

(56) References Cited

U.S. PATENT DOCUMENTS 4,614,246 A * 9/1986 Masse et al. ..... 180/6.5
6,196,343 B1 * 3/2001 Strautnieks ..... 180/22
6,312,000 B1 * 11/2001 Pauls et al. ..... 280/250.1
7,003,381 B2 * 2/2006 Wakefield, II ..... 701/1
7,040,429 B2 5/2006 Molnar
7,370,876 B2 * 5/2008 Hsu et al. ..... 280/650
7,380,824 B2 * 6/2008 Chen et al. ..... 280/755
7,472,767 B2 * 1/2009 Molnar ..... 180/65.1
2007/0209845 A1 * 9/2007 Chen et al. ..... 180/15

* cited by examiner

*Primary Examiner*—Frank B Vanaman
(74) *Attorney, Agent, or Firm*—Frommer Lawrence & Haug LLP; Ronald R Santucci

(57) ABSTRACT

An electric wheelchair suspension includes a supporting frame unit and two linkages. The supporting frame unit includes a bottom frame, two posts, and two main rods. Each of the linkages includes an upper link, a lower link, a front caster rod, a bottom link, and a rear link. The upper links are connected respectively and pivotally to the main rods. The lower links are connected respectively and pivotally to the posts. Each of the front caster rods is connected pivotally to the upper and lower links of a corresponding one of the linkages. The bottom links are connected pivotally to the bottom frame. Each of the rear links is connected pivotally to a corresponding one of the upper links and a corresponding one of the bottom links.

9 Claims, 8 Drawing Sheets

ELECTRIC WHEELCHAIR SUSPENSION

This application claims priority benefits from Taiwanese Patent Application No. 095132184 filed Aug. 31, 2006.

BACKGROUND OF THE INVENTION

1. Field of the Invention

This invention relates to an electric wheelchair, and more particularly to an electric wheelchair suspension.

2. Description of the Related Art

Referring to FIGS. 1 and 2, a conventional suspension 10 disclosed in U.S. Pat. No. 7,040,429 is disposed under a seat 11 of an electric wheelchair, and is controlled by a controller 12. The suspension 10 includes a supporting frame unit 13, a linkage unit 17, a driving unit consisting of two driving mechanisms 25, and a wheel unit 26.

The supporting frame unit 13 includes a bottom frame 14, and a pair of front and rear plates 15, 16 extending respectively from front and rear ends of the bottom frame 14.

The linkage unit 17 includes a pair of linkages 18 (only one is shown in FIG. 1) and a pair of first and second springs 23, 24. Each of the linkages 18 includes a main rod frame 19, an upper link 20 connected pivotally to and extending forwardly from the main rod frame 19, a front caster rod 21 connected pivotally to a front end of the upper link 20, and a lower link 22 connected pivotally to the front caster rod 21 and disposed under and spaced apart from the upper link 20. As such, the linkages 18 are configured as four-bar linkages.

Each of the main rod frames 19 has a horizontal section 191 connected fixedly to the front and rear plates 15, 16 of the supporting frame unit 13, a vertical section 192 extending downwardly from a front end of the horizontal section 191, a rear inclined section 193 extending rearwardly and downwardly from a rear end of the horizontal section 191, and a front inclined section 194 interconnecting the horizontal section 191 and the vertical section 192. The seat 11 is disposed on the horizontal sections 191 of the main rod frames 19.

Each of the upper links 20 has a main link section 201 connected pivotally to the front inclined section 194 of the corresponding main rod frame 19, an upright link section 202 extending downwardly from a rear end of the main link section 201, and an inclined extension section 203 extending forwardly and downwardly from a lower end of the upright link section 202. Each of the first springs 23 is adjacent to the corresponding front caster rod 21, and has an upper end fastened to the main link section 201 of the corresponding upper link 20, and a lower end fastened to a lower end portion of the upright section 192 of the corresponding rod frame 19. Each of the second springs 24 has an upper end fastened to the horizontal section 191 of the corresponding main rod frame 19, and a lower end fastened to the upright section 202 of the corresponding upper link 20.

The driving mechanisms 25 are disposed on the inclined extension sections 203 of the upper links 20, and are coupled electrically to the controller 12.

The wheel unit 26 includes two front casters 27 disposed respectively and rotatably on the front caster rods 21, two rear casters 28 disposed respectively and rotatably on the rear inclined sections 193 of the main rod frames 19, and two driving wheels 29 driven respectively by the driving mechanisms 25.

The controller 12 is operable to control the rotational direction and speed of each of the driving wheels 29 so as to allow for forward, rearward, and steering movement of the wheelchair.

Due to the presence of the linkages 18, the wheelchair can traverse an obstacle, such as a sidewalk. Referring to FIG. 3, when the front casters 27 climb onto a sidewalk area, the main rod frames 19 rotate by a first angle $\theta_1$, and the inclined extension sections 203 (see FIG. 1) of the upper links 20 rotate by a second angle $\theta_2$. On the other hand, the driving wheels 29 slide forwardly from the position shown by the phantom lines in FIG. 3 to that shown by the solid lines in FIG. 3 while the wheelchair is advancing with the driving wheels 29 rotating counterclockwise. Referring to FIG. 4, when the front casters 27 descend from the sidewalk area onto the ground, the main rod frames 19 and the upper links 20 rotate by the first and second angles $\theta_1$, $\theta_2$, respectively, and the driving wheels 29 slide rearwardly from the position shown by the phantom lines in FIG. 4 to that shown by the solid lines in FIG. 4. Since the seat 11 is disposed on the main rod frames 19, such rotation of the main rod frames 19 results in rider discomfort. Furthermore, the driving wheels 29 experience fast wear due to the sliding movement thereof.

FIG. 5 is a graph illustrating five time-angle variation curves for obstacles of different heights (i.e., 10, 20, 30, 40, and 50 mm), which is obtained through a test in which the front casters 27 climb onto the obstacles. The time-angle variation curves illustrate the relationship among the obstacle height, the time spent for the front casters 27 to climb onto the obstacle, and the rotational angle $\theta_1$ of the main rod frames 19 (i.e., the rotational angle of the seat 11). As indicated by the time-angle variation curves, when the height of the obstacle is 50 mm, the rotational angle $\theta_1$ of the main rod frame 19 is more than 2°, which is sufficient to cause rider discomfort.

FIG. 6 is a graph illustrating five other time-angle variation curves for the same obstacles used to obtain the graph of FIG. 5, which illustrates the relationship among the obstacle height, the time spent for the front casters 27 to move from the obstacle onto the ground, and the rotational angle $\theta_2$ of the upper links 20. As illustrated, when the obstacle height is 50 mm, the rotational angle $\theta_2$ of the inclined extension sections 203 of the upper links 20 is more than 10°, thereby resulting in a long sliding distance of the driving wheels 29. This increases wear experienced by the driving wheels 29.

SUMMARY OF THE INVENTION

The object of this invention is to provide an electric wheelchair including an improved suspension that can reduce rider discomfort and wear of driving wheels when the wheelchair climbs onto an elevated surface and when the wheelchair descends from the elevated surface onto the ground.

According to this invention, an electric wheelchair suspension comprises:

a supporting frame unit including a bottom frame, two posts extending respectively and upwardly from two opposite sides of a front end of the bottom frame, and two main rods connected respectively and fixedly to and extending rearwardly from the posts, the bottom frame having two aligned first pivot portions disposed respectively at two opposite sides thereof, each of the posts having a second pivot portion, each of the main rods having a third pivot portion;

a linkage unit including two linkages disposed respectively on two opposite sides of the supporting frame unit, each of the linkages including an upper link connected pivotally to the third pivot portion of a corresponding one of the main rods and extending in a front-to-rear direction, the upper link having a front pivot portion disposed in front of the third pivot portion of the corresponding one of the main rods, and a rear pivot portion disposed behind the third pivot portion of the corresponding one of the main rods, a lower link connected pivotally to the second pivot portion of a corresponding one of the posts and having a front pivot portion disposed in front of the second pivot portion of the corresponding one of the posts, a front caster rod connected pivotally to the front pivot portions of the upper and lower links, a bottom link connected pivotally to a corresponding one of the first pivot portions of the bottom frame and having a rear pivot portion disposed behind the corresponding one of the first pivot portions of the bottom frame, and a rear link connected pivotally to the rear pivot portions of the upper link and the bottom link;

a wheel unit disposed on an assembly of the supporting frame unit sand the linkage unit; and a driving unit for driving the wheel unit.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
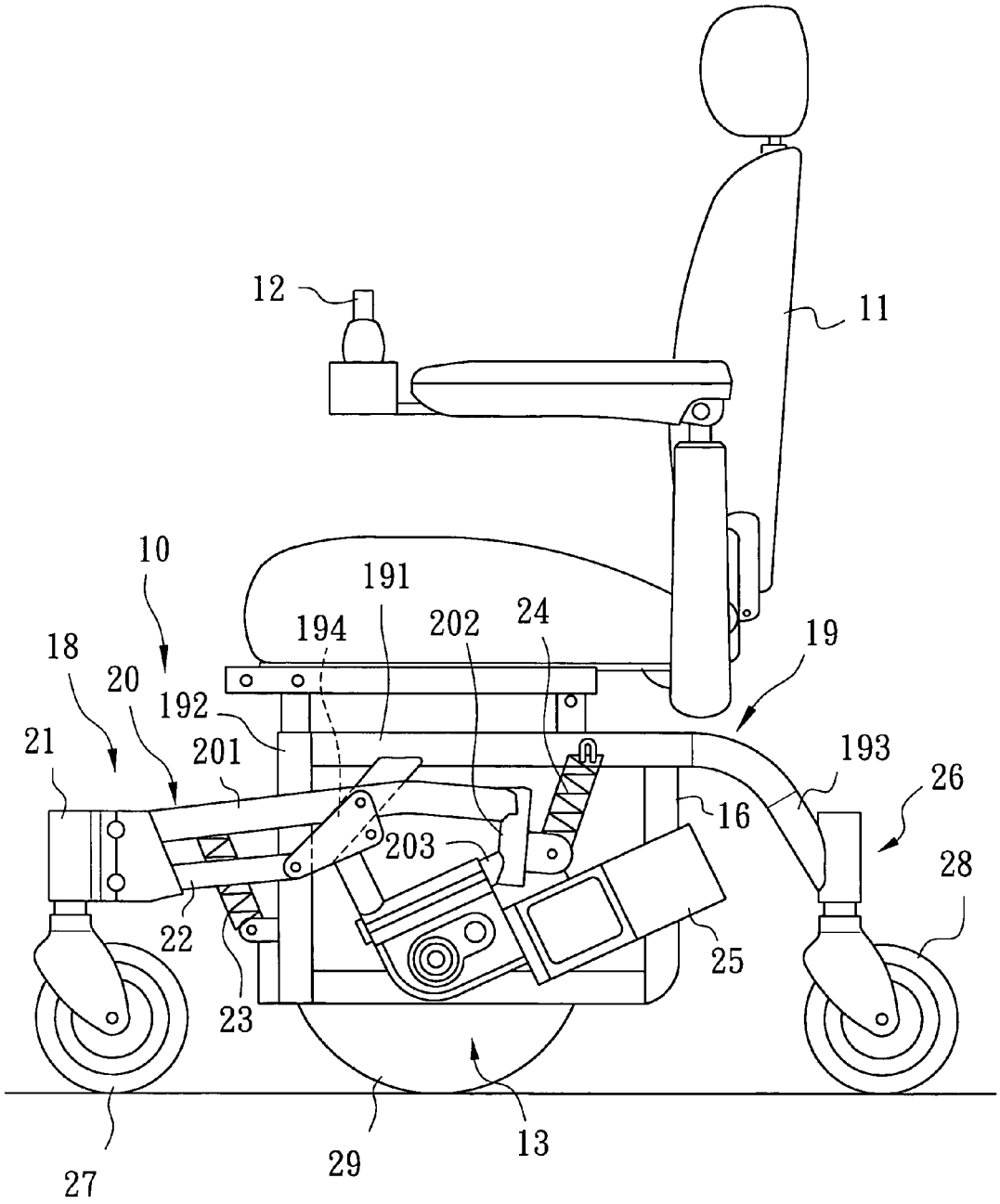
FIG. 1 PRIOR ART
FIG. 1 is a side view of a conventional electric wheelchair mounted with a suspension disclosed in U.S. Pat. No. 7,040,429.
Figure 2:
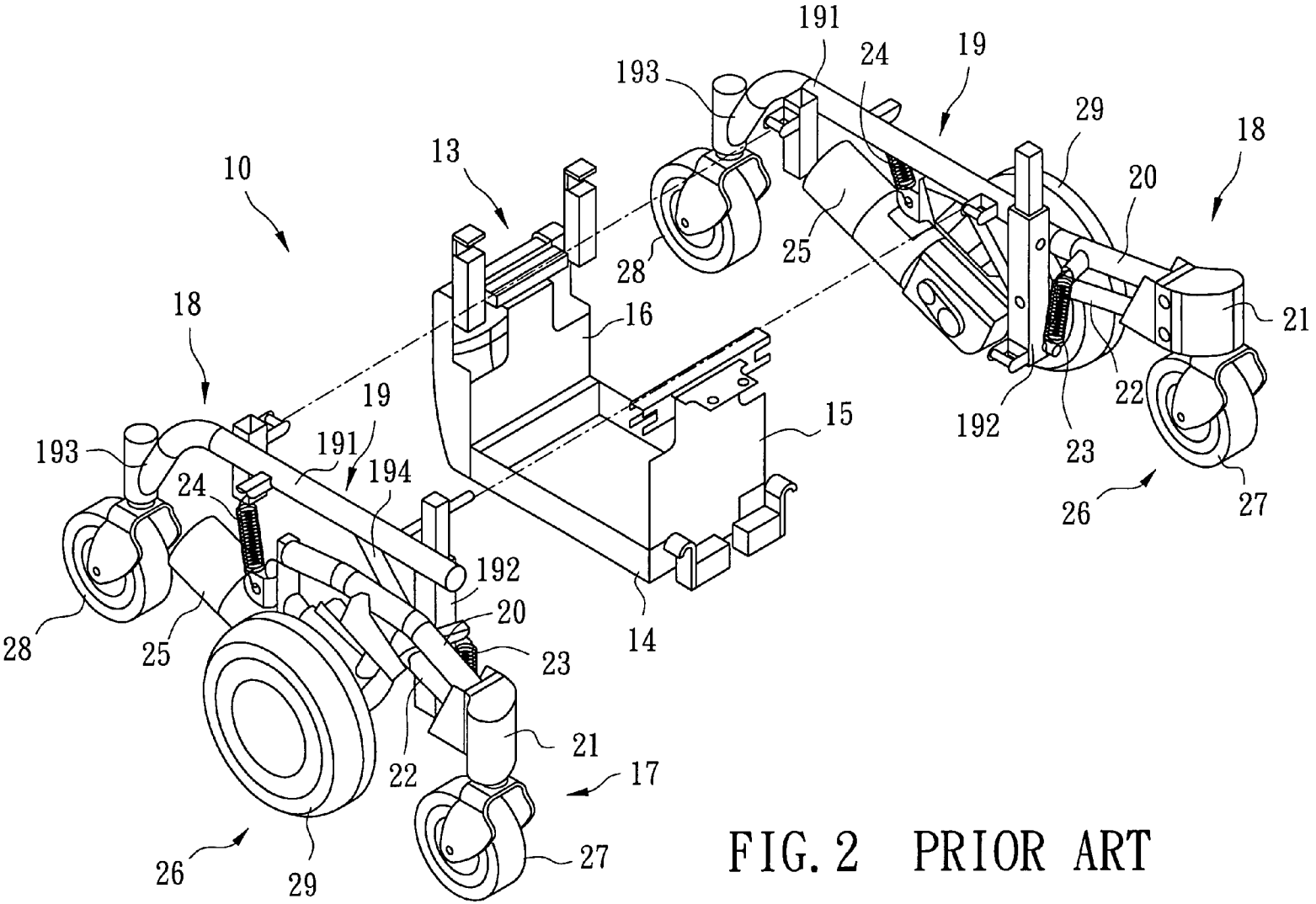
FIG. 2 PRIOR ART
FIG. 2 is a partly exploded perspective view of the conventional electric wheelchair.
Figure 3:
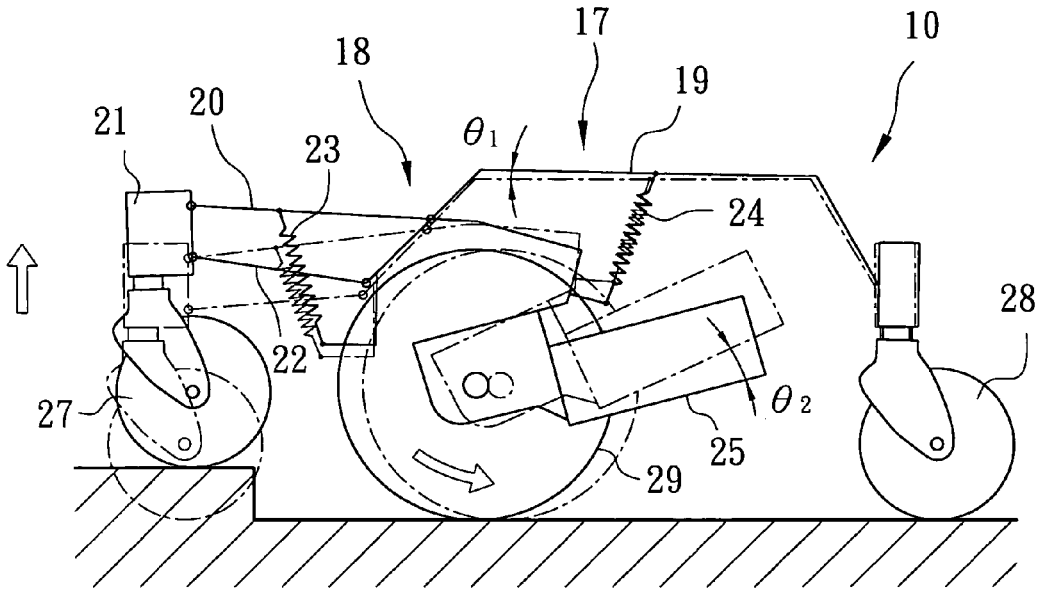
FIG. 3 PRIOR ART
FIG. 3 is a schematic side view of the conventional electric wheelchair, illustrating how front casters climb onto a sidewalk area.
Figure 4:
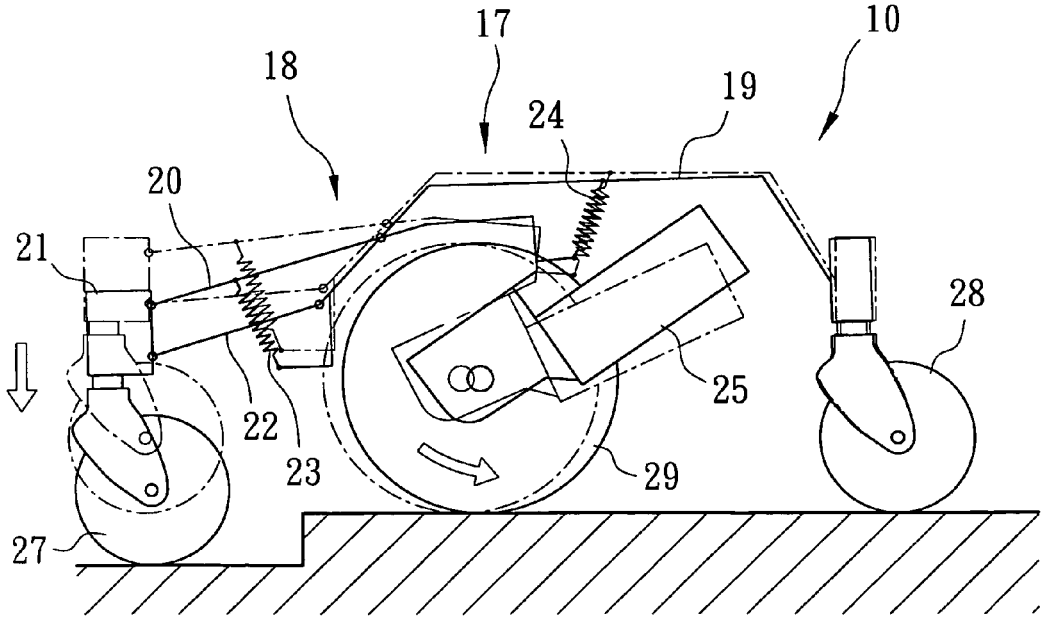
FIG. 4 PRIOR ART
FIG. 4 is a schematic side view of the conventional electric wheelchair, illustrating how the front casters move from the sidewalk area onto the ground.
Figure 5:
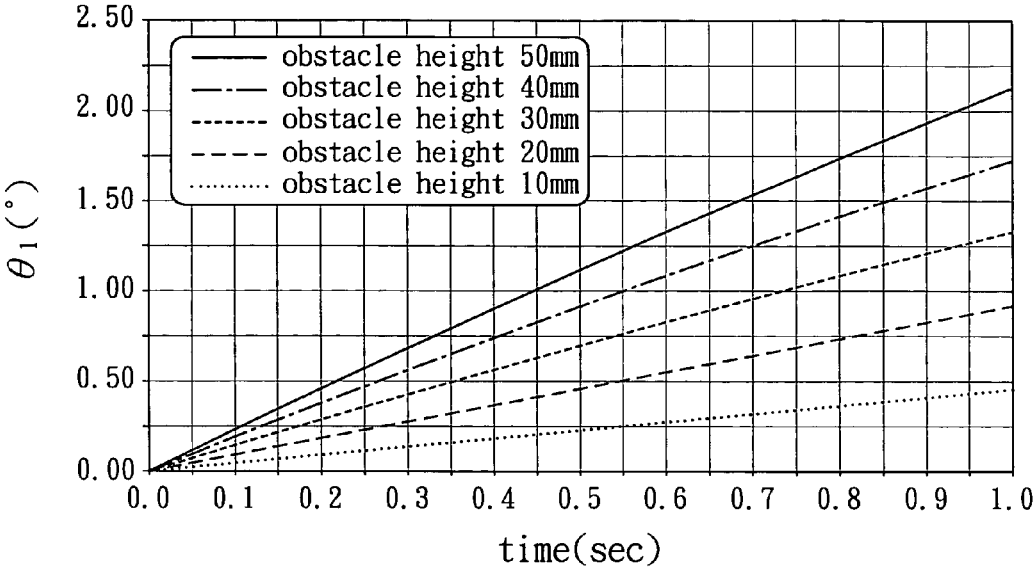
FIG. 5 PRIOR ART
FIG. 5 is a graph illustrating various time-angle variation curves that indicate how the rotational angle of two mainframe rods of the conventional electric wheelchair is changed according to the height of obstacle when the front casters climb onto the obstacle.
Figure 6:
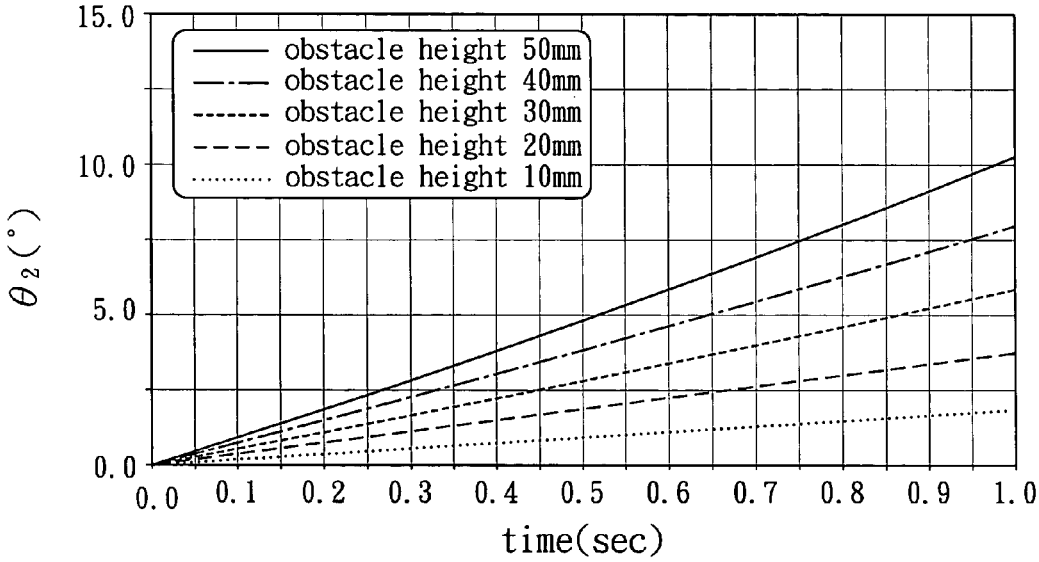
FIG. 6 PRIOR ART
FIG. 6 is a graph illustrating various time-angle variation curves that indicate how the rotational angle of two upper links of the conventional electric wheelchair is changed according to the height of the obstacle when the front casters move from the obstacle onto the ground.
Figure 7:
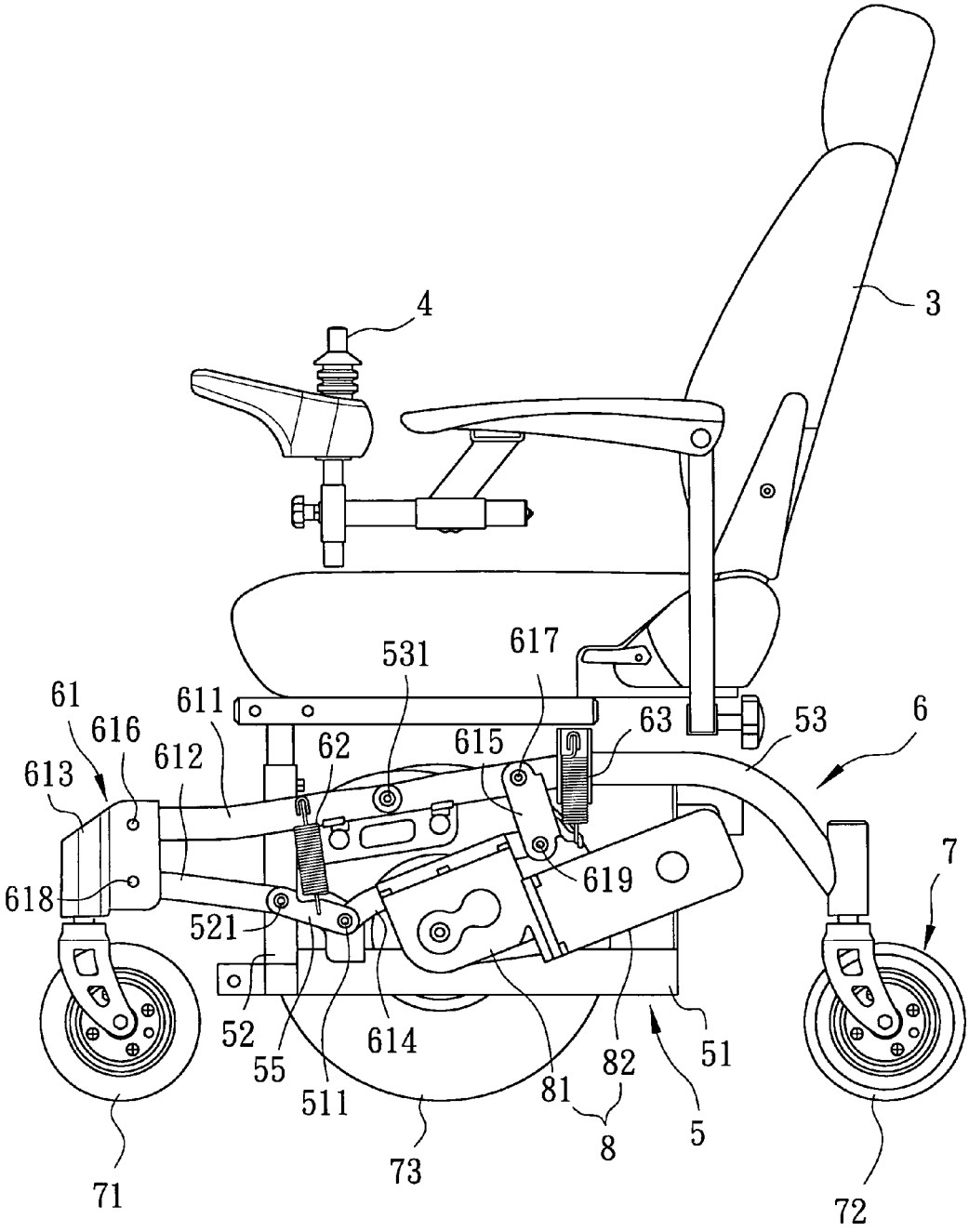
FIG. 7 is a side view of an electric wheelchair mounted with the preferred embodiment of an electric wheelchair suspension according to this invention, which is disposed under a seat and which is controlled by a controller.
Figure 8:
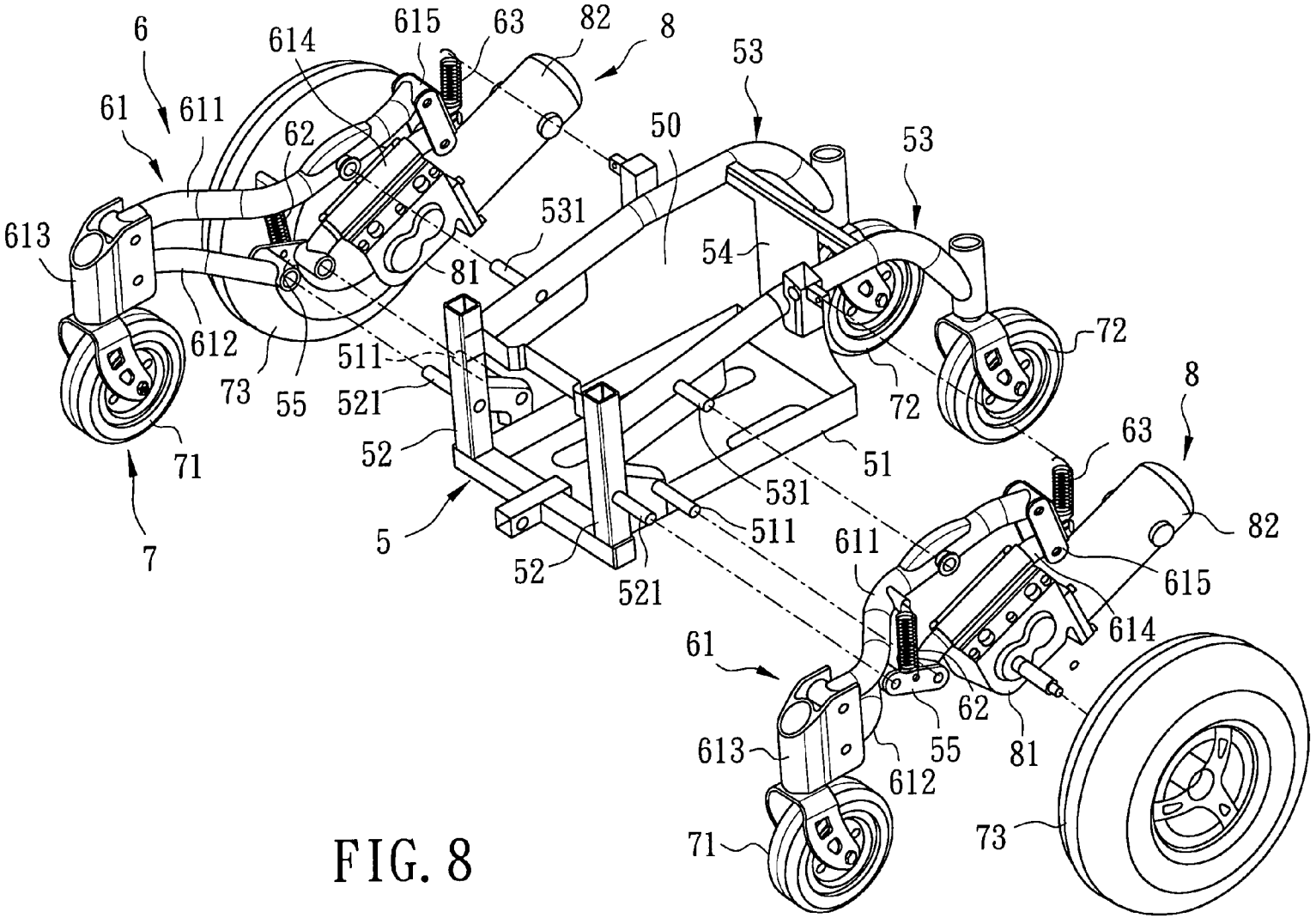
FIG. 8 is a partly exploded perspective view of the electric wheelchair shown in FIG. 7.

Referring to FIGS. 7 and 8, the preferred embodiment of an electric wheelchair suspension according to this invention is disposed under a seat 3, and is controlled by a controller 4. The wheelchair suspension includes a supporting frame unit 5, a linkage unit 6, a wheel unit 7, and a driving unit consisting of two driving mechanisms 8.

The supporting frame unit 5 includes a generally rectangular bottom frame 51, two posts 52 extending respectively and upwardly from two opposite sides of a front end of the bottom frame 51, two main rods 53 connected respectively and fixedly to and extending rearwardly from the posts 52, a rear plate 54 extending upwardly from a rear end of the bottom frame 51 and connected fixedly to the main rods 53, and two connecting plates 55. The bottom frame 51, the posts 52, the main rods 53, and the rear plate 54 define cooperatively a space 50 for accommodating an electricity storage device (not shown), such as a rechargeable battery. The electricity storage device can supply electricity to the driving mechanisms 8. The seat 3 is disposed fixedly on the main rods 53.

The bottom frame 51 has two aligned first pivot portions 511 disposed respectively at two opposite sides thereof. Each of the posts 52 has a second pivot portion 521 disposed in proximity to the corresponding first pivot portion 511. Each of the main rods 53 has a third pivot portion 531. Each of the first, second, and third pivot portions 511, 521, 531 is configured as a horizontal pin.

Each of the connecting plates 55 has two ends sleeved respectively on the corresponding first and second pivot portions 511, 521 in a close fitting manner. As such, the connecting plates 55 cannot move relative to the bottom frame 51 and the posts 52.

The linkage unit 6 includes two linkages 61 disposed respectively on two opposite sides of the supporting frame unit 5, two coiled first compression springs 62, and two coiled second compression springs 63.

Each of the linkages 61 includes an upper link 611, a lower link 612, a front caster rod 613, a bottom link 614, and a rear link 615. Each of the upper and lower links 611, 612 extends along a front-to-rear direction. One of the linkages 61 will be described in the succeeding paragraph.

The upper link 611 is connected pivotally to the corresponding third pivot portion 531, and has a front pivot portion 616 disposed in front of the corresponding third pivot portion 531, and a rear pivot portion 617 disposed behind the corresponding third pivot portion 531. The lower link 612 is connected pivotally to the corresponding second pivot portion 521, and has a front pivot portion 618 disposed in front of the corresponding second pivot portion 521. The front caster rod 613 is connected pivotally to the front pivot portions 616, 618 of the upper and lower links 611, 612. The bottom link 614 is connected pivotally to the corresponding first pivot portion 511, and has a rear pivot portion 619 disposed behind the corresponding first pivot portion 511. The rear link 615 is connected pivotally to the rear pivot portions 617, 619 of the upper link 611 and the bottom link 614. At either side of the supporting frame unit 5, the main rod 53, the upper link 611, the lower link 612, the front caster rod 613, the bottom link 614, and the rear link 615 constitute cooperatively a so-called "six-bar linkage."

Each of the first compression springs 62 has two ends fastened respectively to the corresponding connecting plates 55 and the corresponding upper link 611. Each of the second compression springs 63 has two ends fastened respectively to the corresponding rear link 615 and the corresponding main rod 53, and cooperates with the corresponding first compression spring 62 so as to bias the corresponding linkage 61 to a normal position shown in FIG. 7.

The wheel unit 7 includes two front casters 71 disposed respectively and rotatably on the front caster rods 613, two rear casters 72 disposed respectively and rotatably on rear ends of the main rods 53, and two driving wheels 73 connected respectively to the driving mechanisms 8.

Each of the driving mechanisms 8 includes a speed reduction gearbox 81 disposed on the corresponding bottom link 614 for driving the corresponding driving wheel 73, and a motor 82 coupled electrically to the controller 4 for driving the speed reduction gearbox 81.

Figure 9:
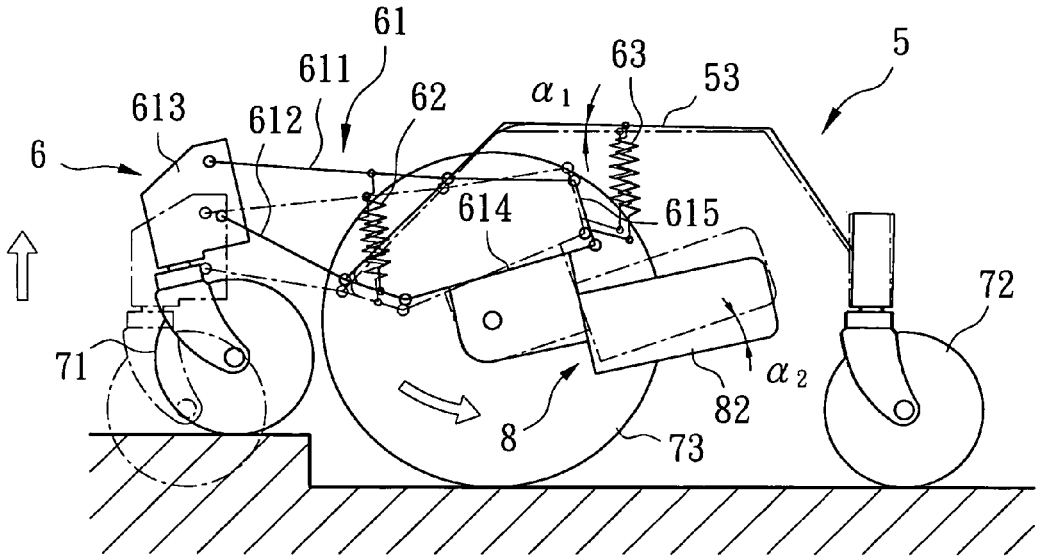
FIG. 9 is a schematic side view of the electric wheelchair shown in FIG. 7, illustrating how front casters climb onto a sidewalk area.
Figure 10:
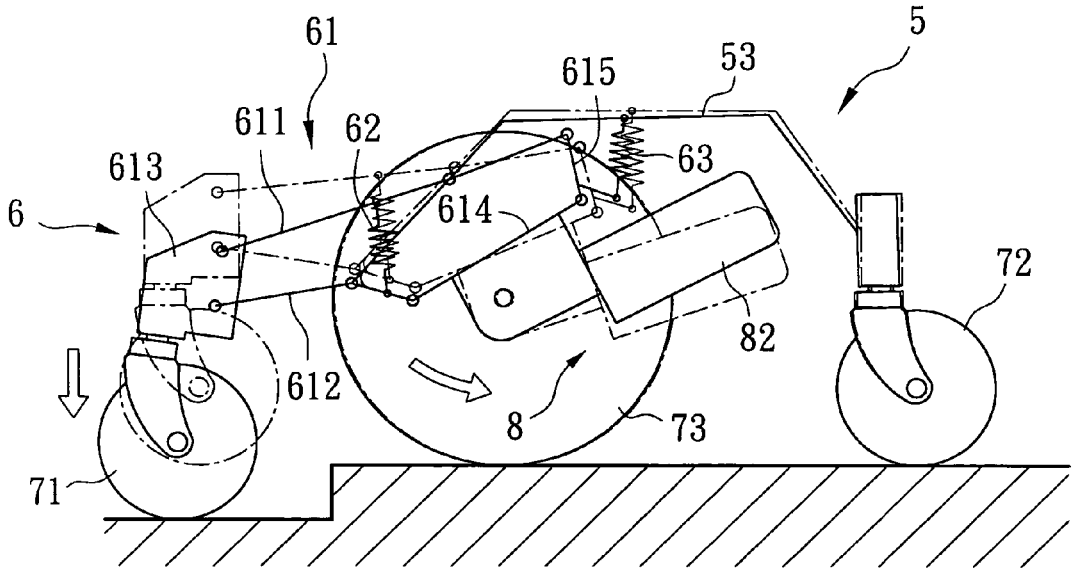
FIG. 10 is a schematic side view of the electric wheelchair shown in FIG. 7, illustrating how the front casters move from the sidewalk area onto the ground.

Referring to FIG. 9, when the front casters 71 climb onto an obstacle, such as a sidewalk area, with the driving wheels 73 rotating counterclockwise, the main rods 53 rotate by a first angle $\alpha_1$, and the bottom links 614 rotate by a second angle $\alpha_2$. Referring to FIG. 10, when the front casters 71 descend from the obstacle onto the ground, the main rods 53 and the bottom links 614 rotate by the first and second angles $\alpha_1$, $\alpha_2$, respectively. During such climbing and descending movement of the front casters 71, sliding movement of the driving wheels 73 is minimal. Thus, the driving wheels 73 experience less wear than those disclosed in U.S. Pat. No. 7,040,429.

Figure 11:
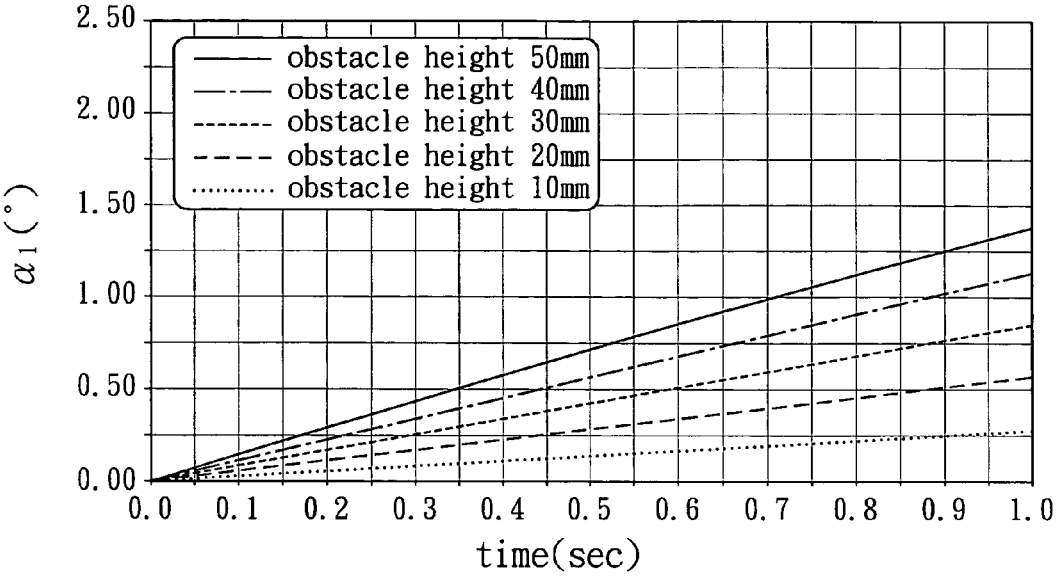
FIG. 11 is a graph illustrating various time-angle variation curves that indicate how the rotational angle of two main frame rods of the preferred embodiment is changed according to the height of obstacle when the front casters climb onto the obstacle.

FIG. 11 is a graph illustrating five time-angle variation curves for obstacles of different heights (i.e., 10, 20, 30, 40, and 50 mm), which is obtained through a test in which the front casters 71 climb onto the obstacles. The time-angle variation curves illustrate the relationship among the obstacle height, the time spent for the front casters 71 to climb onto the obstacle, and the rotational angle $\alpha_1$ of the main rods 53 (i.e., the rotational angle of the seat 3). As indicated by the time-angle variation curves, when the height of the obstacle is 50 mm, the rotational angle $\alpha_1$ of the main rod frame 19 is less than 1.5°. This reduces rider discomfort.

Figure 12:
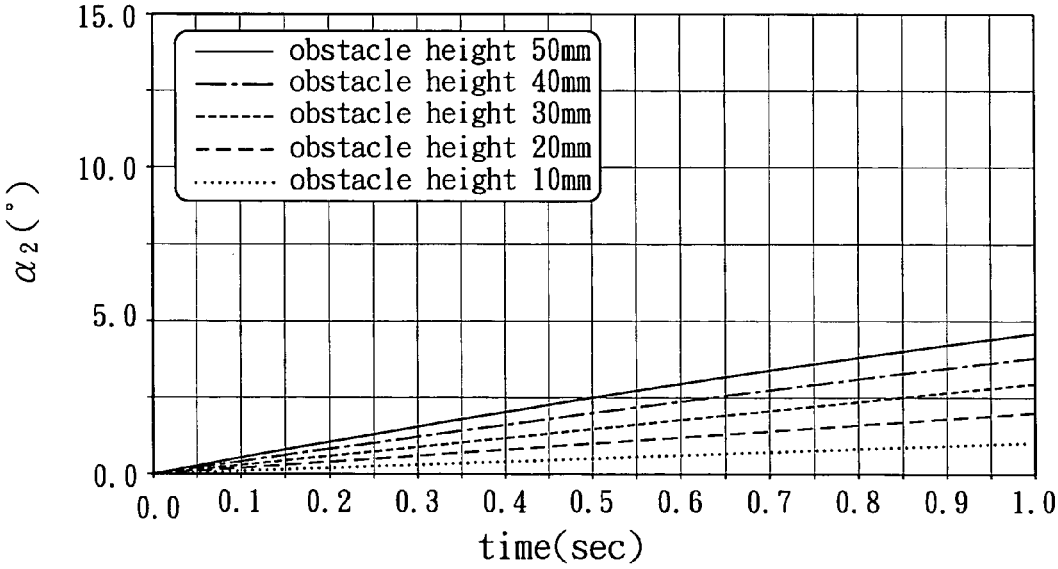
FIG. 12 is a graph illustrating various time-angle curves that indicate how the rotational angle of two upper links of the preferred embodiment is changed according to the height of the obstacle when the front casters climb move from the obstacle onto the ground.

FIG. 12 is a graph illustrating five other time-angle variation curves for the same obstacles used to obtain the graph of FIG. 11, which illustrates the relationship among the obstacle height, the time spent for the front casters 71 to move from the obstacle onto the ground, and the rotational angle $\alpha_2$ of the bottom links 614. As illustrated, when the obstacle height is 50 mm, the rotational angle $\alpha_2$ of the inclined extension sections 203 of the upper links 20 is less than 5° so as to minimize the sliding movement and, thus, wear of the driving wheels 73.

With this invention thus explained, it is apparent that numerous modifications and variations can be made without departing from the scope and spirit of this invention. It is therefore intended that this invention be limited only as indicated by the appended claims.

We claim:

1. An electric wheelchair suspension comprising:

a supporting frame unit including a bottom frame, two posts extending respectively and upwardly from two opposite sides of a front end of said bottom frame, and two main rods connected respectively and fixedly to and extending rearwardly from said posts, said bottom frame having two aligned first pivot portions disposed respectively at two opposite sides thereof, each of said posts having a second pivot portion, each of said main rods having a third pivot portion;

a linkage unit including two linkages disposed respectively on two opposite sides of said supporting frame unit, each of said linkages including an upper link connected pivotally to said third pivot portion of a corresponding one of said main rods and extending in a front-to-rear direction, said upper link having a front pivot portion disposed in front of said third pivot portion of said corresponding one of said main rods, and a rear pivot portion disposed behind said third pivot portion of said corresponding one of said main rods, a lower link connected pivotally to said second pivot portion of a corresponding one of said posts and having a front pivot portion disposed in front of said second pivot portion of said corresponding one of said posts, a front caster rod connected pivotally to said front pivot portions of said upper and lower links, a bottom link connected pivotally to a corresponding one of said first pivot portions of said bottom frame and having a rear pivot portion disposed behind said corresponding one of said first pivot portions of said bottom frame, and a rear link connected pivotally to said rear pivot portions of said upper link and said bottom link;

a wheel unit disposed on an assembly of said supporting frame unit and said linkage unit; and a driving unit for driving said wheel unit.

2. The electric wheelchair suspension as claimed in claim 1, wherein said linkage unit further includes:

two coiled first compression springs each having two ends fastened respectively to said supporting frame unit and said upper link of a corresponding one of said linkages; and two coiled second compression springs each having two ends fastened respectively to a corresponding one of said rear links and a corresponding one of said main rods of said supporting frame unit.

3. The electric wheelchair suspension as claimed in claim 2, wherein each of said first pivot portions of said bottom frame and said second pivot portions of said posts is configured as a horizontal pin, said supporting frame unit further including two connecting plates each having two ends sleeved respectively on a corresponding one of said first pivot portions of said bottom frame and said second pivot portion of a corresponding one of said posts in a close fitting manner, said ends of said first compression spring of said linkage unit being fastened respectively to a corresponding one of said connecting plates and said upper link of said corresponding one of said linkages.

4. The electric wheelchair suspension as claimed in claim 3, wherein said wheel unit includes two driving wheels, said driving unit including two speed reduction gearboxes disposed respectively on said bottom links of said linkages for driving said driving wheels, respectively, and two motors for driving said speed reduction gearboxes, respectively.

5. The electric wheelchair suspension as claimed in claim 4, wherein said wheel unit further includes two front casters disposed respectively and rotatably on said front caster rods of said linkages, and two rear casters disposed respectively and rotatably on said main rods of said supporting frame unit.

6. The electric wheelchair suspension as claimed in claim 1, wherein said supporting frame unit further includes a rear plate extending upwardly from a rear end of said bottom frame and connected fixedly to said main rods.

7. The electric wheelchair suspension as claimed in claim 1, wherein said wheel unit includes two driving wheels, said driving unit including two speed reduction gearboxes disposed on respectively on said bottom links of said linkages for driving said driving wheels, respectively, and two motors for driving said speed reduction gearboxes, respectively.

8. The electric wheelchair suspension as claimed in claim 7, wherein said wheel unit further includes two front casters disposed respectively and rotatably on said front caster rods of said linkages, and two rear casters disposed respectively and rotatably on said main rods of said supporting frame unit.

9. The electric wheelchair suspension as claimed in claim 8, wherein said supporting frame unit further includes a rear plate extending upwardly from a rear end of said bottom frame and connected fixedly to said main rods.

* * * * *